US006543518B1

(12) United States Patent
Bend et al.

(10) Patent No.: US 6,543,518 B1
(45) Date of Patent: Apr. 8, 2003

(54) APPARATUS AND METHOD FOR CASTING

(75) Inventors: Robert J. Bend, Plymouth, MI (US); Clifford B. Rothwell, Waterford, MI (US)

(73) Assignee: Tooling & Equipment International, Livonia, MI (US)

( * ) Notice: Subject to any disclaimer, the term of this patent is extended or adjusted under 35 U.S.C. 154(b) by 0 days.

(21) Appl. No.: 09/696,486

(22) Filed: Oct. 25, 2000

Related U.S. Application Data

(60) Provisional application No. 60/161,253, filed on Oct. 25, 1999.

(51) Int. Cl.[7] ..... B22D 5/02; B22D 15/00

(52) U.S. Cl. ..... 164/325; 164/322; 164/323; 164/324; 164/326; 164/327; 164/353; 164/355

(58) Field of Search ..... 164/457, 453, 164/151.3, 151.2, 353, 355, 119, 113, 326, 327, 322–325

(56) References Cited

U.S. PATENT DOCUMENTS

| | | | | | |
|---|---|---|---|---|---|
| 4,432,046 | A | * | 2/1984 | Phillips | 164/119 |
| 5,297,611 | A | * | 3/1994 | Legge | 164/353 |
| 5,526,870 | A | * | 6/1996 | Odegard | 164/453 |
| 5,836,373 | A | * | 11/1998 | Hansen | 164/167 |

FOREIGN PATENT DOCUMENTS

| | | | |
|---|---|---|---|
| JP | 61-180666 | * | 8/1986 |
| JP | 6238392 | * | 8/1994 |

* cited by examiner

*Primary Examiner*—Tom Dunn
*Assistant Examiner*—I.-H. Lin
(74) *Attorney, Agent, or Firm*—Howard & Howard

(57) ABSTRACT

The present invention relates to casting and more particularly to an improved apparatus and method of aluminum casting. The casting system 10 includes a furnace 12, a pump 14 and a mold 16. A semi-permanent mold cope 30 is mounted to the top of the mold 16 to quickly cool the adjacent portion of the casting 20. The semi-permanent mold cope 30 is movable with respect to the mold so that it can be moved between an open and closed position. The mold 16 can be brought to the semi-permanent mold cope 30 when the semi-permanent mold cope 30 is open and the semi-permanent mold cope 30 can then be closed onto the casting 20. The molten metal is then pumped into the mold 16 with the semi-permanent mold cope 30 in place. A laser 34 monitors the rate of mold fill by monitoring the fill rate of the riser 28. After the mold 16 has been filled with molten metal, the mold sprue is closed and a turntable 32 can be rotated to bring the next mold 30 into position with the furnace 12 and rotate the filled mold away from the furnace 12 to allow it to cool.

12 Claims, 7 Drawing Sheets

APPARATUS AND METHOD FOR CASTING

RELATED APPLICATION

This application claims priority to provisional patent application Ser. No. 60/161,253 which was filed on Oct. 25, 1999.

BACKGROUND

The present invention relates to metal casting apparatus and methods of casting and more particularly to the use of a semi-permanent mold cope for casting aluminum. More particularly, the present invention is directed to an improved apparatus and method of casting aluminum with the use of precision sand and controlled cooling through the use of a semi-permanent mold cope.

For purposes of explanation, reference will be made to the use of the present invention with respect to the casting of engine blocks. It should be understood by those of ordinary skill in the art that the invention is not limited to use in casting engine blocks and can be used in casting other products.

Engine blocks have traditionally been cast from iron using sand casting. One of the distinct advantages of castings is that hollow or reentrant sections can be included with relative ease. Generally, sand casting involves the creation of a pattern that is placed in a mold or flask. The mold is then filled with sand. The sand includes a binder that is activated to bind the sand together. After the binder has been activated, the pattern is removed and molten metal can be poured into a sprue that is connected to runners that are fluidly connected to the sand casting. Risers are also used to provide metal to the casting as the metal cools and shrinks. The risers are connected to the runners. After the mold has been filled and allowed to cool, the sand is extracted from the product.

Although iron has traditionally been used to cast engine blocks, aluminum is becoming more desirable because of its reduced weight. Casting aluminum engine blocks from sand castings is relatively new and has inherent problems. One of the biggest problems is the difficulty in providing more rapid cooling at desired areas of the aluminum engine block. Traditionally, a chill provided quicker cooling. A chill is a portion of the mold that is colder than other mold portions and causes the adjacent molten metal to solidify faster than remote metal causing the more rapidly cooled area to have increased mechanical properties. It is important to provide targeted increased mechanical properties in the product being cast. For example, when casting an engine block, the bottom of the engine block where the crankshaft is connected needs to have greater mechanical properties than other portions of the engine block.

Another problem with sand casting in general is the space that is required to house the casting operation and the time involved in the casting process. What is needed is a more compact quicker casting operation.

SUMMARY OF THE INVENTION

The present invention is an improved casting system including a precision fill system, a turntable loading system, and a precision mold system with semi-permanent mold cope application. The improved fill system includes a laser measurement device and a computer system for monitoring and controlling the fill rate of a casting mold with molten metal. Precisely controlling the fill rate of the mold results in a stronger casting. The turntable loading system of the present invention includes a turntable whereupon numerous molds may be loaded, rotated into position with a furnace, and rotated again to cool. The turntable system speeds up the casting process and uses a minimum footprint of space in the casting facility. The semi-permanent mold cope system of the present invention permits the use of a removable semi-permanent mold cope or to more rapidly cool certain areas of the mold. In this way, the casting can be easily provided with desired qualities at precise locations and post solidification operations can be more precisely and economically performed.

DETAILED DESCRIPTION OF THE INVENTION

Figure 1:
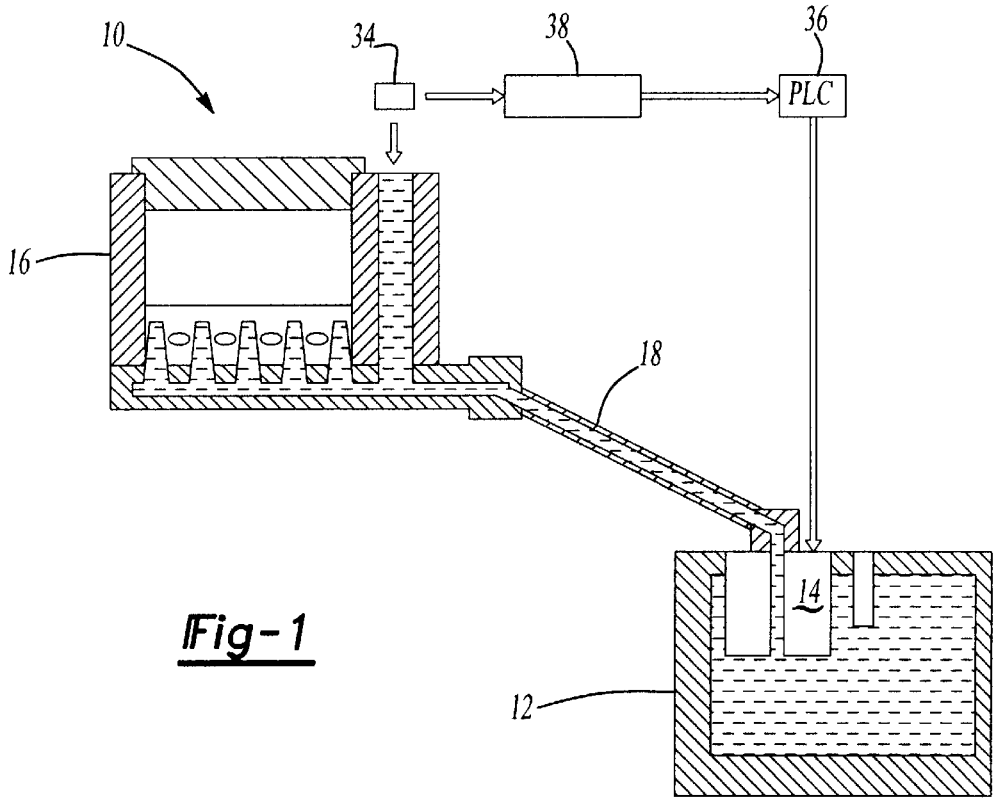
FIG. 1 is a schematic view of the sand casting process of the present invention.
Figure 2:
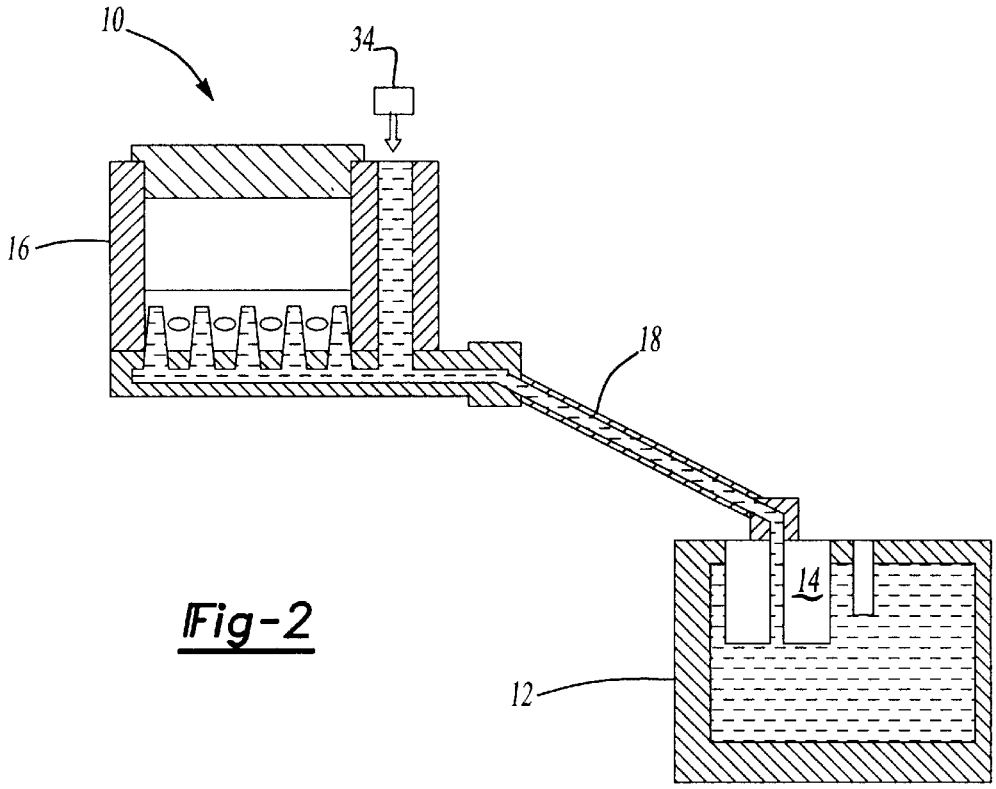
FIG. 2 is a schematic view similar to FIG. 1.

With reference to FIGS. 1 and 2, the casting system of the present invention is shown generally at 10. The casting system 10 generally includes a furnace 12, a pump 14 and a mold 16. The furnace 12 maintains the metal, preferably aluminum, in a molten state so that it can be pumped to the mold 16. In the disclosed embodiment, The pump 14 is an electromagnetic pump that allows the molten aluminum to be pumped through a laundered 18 interconnecting the furnace 12and mold 16. In this way, the aluminum is not exposed to the atmosphere providing a better molten metal. The electromagnetic pump 14 is a known design to those of ordinary skill in the art and will not be described in detail. The pump 14 is controlled through a laser 34, computer 36 and computer software, such as for example fuzzy logic 38.

Figure 3:
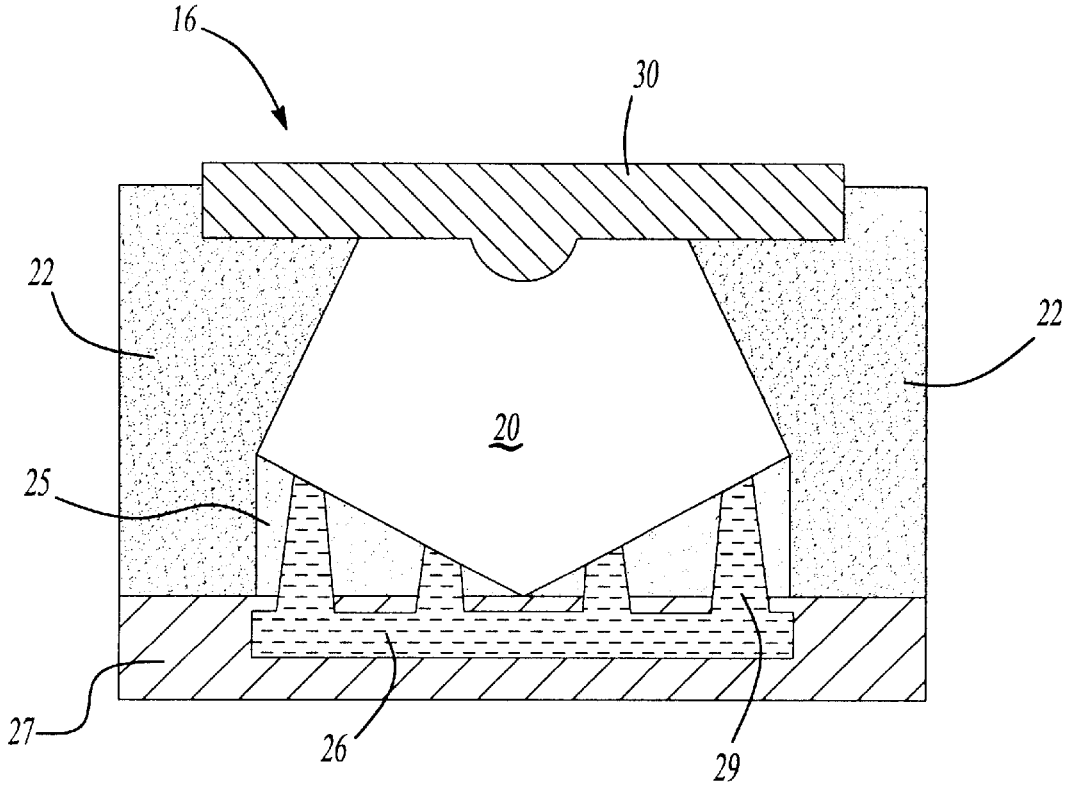
FIG. 3 is a cross sectional view of the mold of the present invention viewed from the front of the mold.
Figure 4:
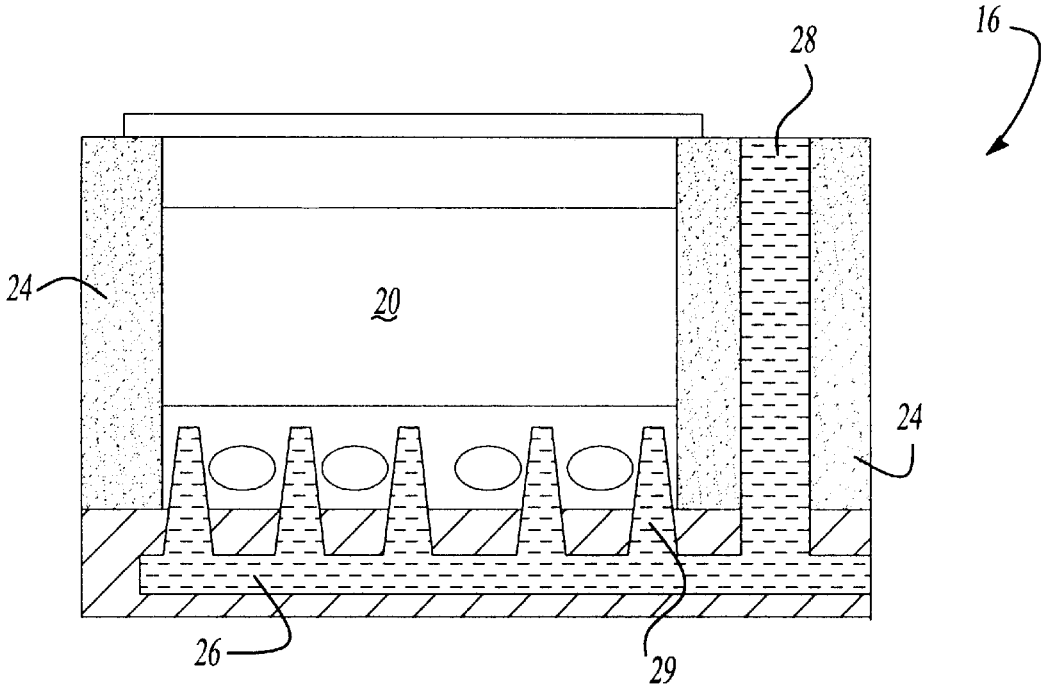
FIG. 4 is a cross sectional view of the mold of the present invention viewed from the side of the mold.

With reference to FIGS. 3 and 4, an example of a mold 16 of the casting system 10 is illustrated. The mold 16 has a casting 20 contained between side cores 22 and front and rear portions 24. The side cores 22 are made of sand by known sand pattern methods. A plurality of runners 26 provide paths for the molten aluminum to reach the casting 20 and a riser 28 provides additional molten metal to the runners 26 as the casting 20 begins to solidify and shrinks. The mold 16 is also illustrated with head stabs 25 and a drag 27. The riser 28 feeds the runners 26 by gravity. As illustrated, the riser 28 maintains pressure on the bottom risers 29.

A semi-permanent mold cope 30 is mounted to the top of the mold 16 to quickly cool the adjacent portion of the casting 20. Quick cooling provides a harder surface at required locations in the casting 20. In the disclosed embodiment, the casting 20 is a vehicle engine block. The semi-permanent mold cope 30 is positioned to quickly cool the bottom of the engine block that receives the crankshaft of the vehicle. This area of the engine block needs to be harder and more durable because of the forces exerted upon this area of the engine block.

Figure 5:
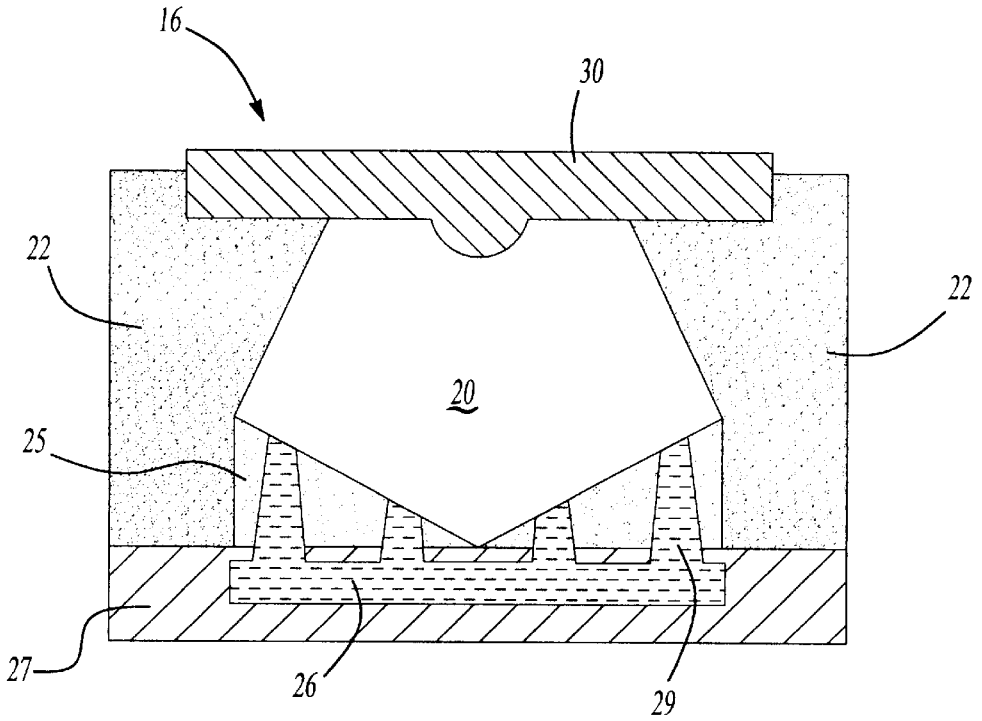
FIG. 5 is a cross sectional view of the mold with the semi-permanent mold cope in place.
Figure 6:
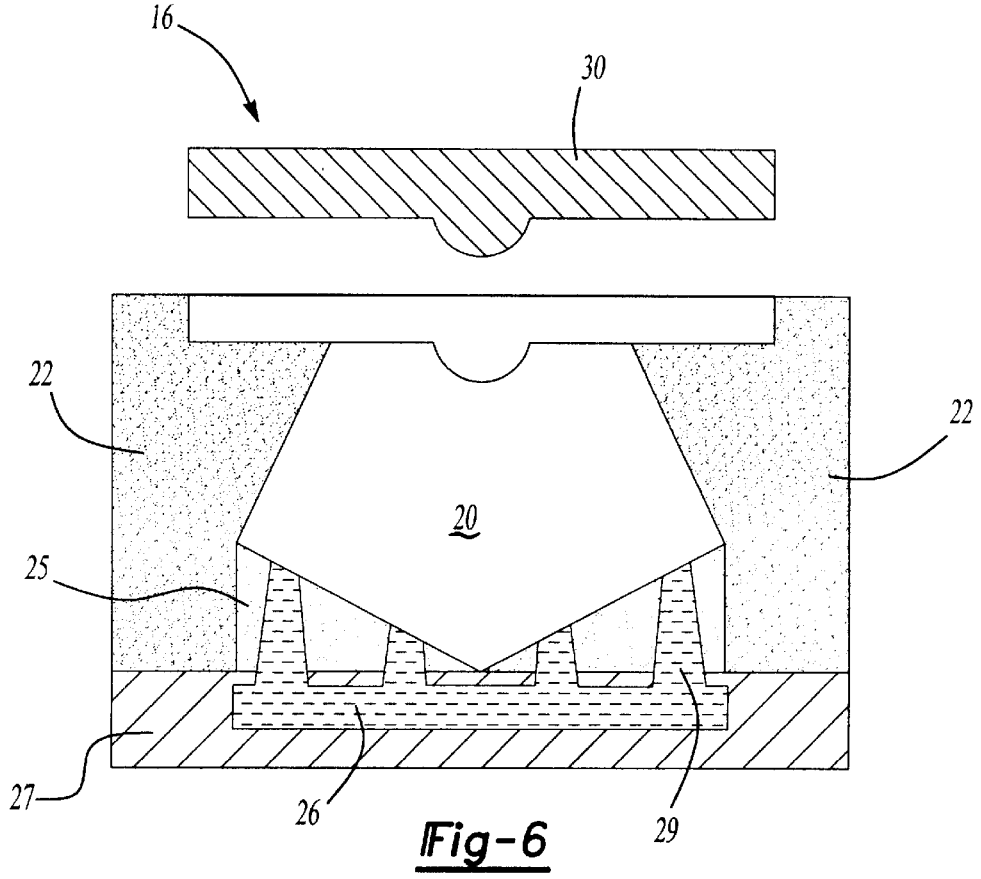
FIG. 6 is a cross sectional view of the mold with the semi-permanent mold cope removed.

In the disclosed embodiment, the semi-permanent mold cope 30 is made of steel, for example, H-13 mold steel, but could be made of other materials, such as for example, iron and can include flow channels for cooling fluids circulation. In addition, the semi-permanent mold cope 30 is able to be moved from an engaged position to a disengaged position. See FIGS. 5 and 6. In this way, each mold 16 doesn't require a separate semi-permanent mold cope 30. The mold 16 can be brought to the semi-permanent mold cope 30 when the semi-permanent mold cope 30 is open and the semi-permanent mold cope 30 can then be closed onto the casting 20. Having a semi-permanent mold cope 30 that is adapted to close upon mold 16 as they are brought into registry with the semi-permanent mold cope provides numerous advantages including cost savings, increased casting speeds, and the ability to reduce the space required for the casting process.

One advantage to the semi-permanent mold cope 30 of the present invention is that it permits the use of a turntable 32 to increase the speed of the casting process and reduce the required space for the casting equipment. In the disclosed embodiment, the turntable 32 has semi-permanent mold copes 30 mounted to the turntable 32 that rotate with the turntable 32. In the disclosed embodiment, the mold 16 is positioned upon the turntable 32 and the turntable is rotated to the furnace 12 where it is connected to the mold assembly 16. A mold cart 52 can be used to bring the mold 16 to the turntable 32. This will be described in greater detail below. The molten metal is then pumped into the mold 16 with the semi-permanent mold cope 30 in place. As will be appreciated, the semi-permanent mold cope 30 could have water piped to it to enhance the semi-permanent mold copeing process. In the preferred embodiment, the semi-permanent mold cope 30 is hydraulically controlled, but other methods could be employed including pneumatic, manual, electric, mechanical etc. After the mold 16 has been filled with molten metal, the mold sprue is closed and the turntable 32 is rotated to bring the next mold 16 into position with the furnace 12 and rotate the filled mold away from the furnace 12 to allow it to cool. As the filled mold 30 cools it continually rotates to a removal station 106, where it can be removed and further cooled and processed in the cooling and processing station 110. See FIG. 7.

The exposed metal surface of the casting 20 provides additional advantages to the molding process. One advantage is the ability to provide additional cooling to the exposed metal surface through the use of blowers, etc. Another advantage is to use the exposed metal surface for location of the mold 16. The exposed surface could have locators that allow precise location of the mold 16 for further processing. For example, the mold 16 could be precisely located on the cart 52 or a subsequent cart 52 or handled by a robotic arm to facilitate removal of the sand from the casting 20. With the mold 16 precisely located, heat could be focused on the sand to break the binders more rapidly or robotic arms could peel away the sand from the casting 20. These steps would normally occur in the cooling station 110.

In the disclosed embodiment, the molten metal flow is carefully controlled through the use of the laser 34 that is connected to the computer 36 which uses software, such as fuzzy logic 38 to control the voltage supplied to pump 14. The laser 34 monitors the rate of fill of the mold 16 by monitoring the riser 28. As is well known, improved product characteristics are obtained if the mold 16 is filled at a constant fill rate. However, with intricate castings, the molten metal rate of fill varies as the metal is forced into small passages as opposed to larger passages and open areas. By way of example, if the pump 14 is set at a specific pump rate, the mold fill rate will vary as the metal is pumped into different areas of the mold 16. By monitoring the fill rate of the riser 28 and maintaining the riser 28 fill rate at a constant rate by controlling the voltage to pump 14, constant fill is maintained throughout the mold 16. As the molten metal reaches a large open area in the mold 16, the pump 14 is slowed and in narrow passages the pump 14 rate is increased. Since a liquid always seeks its own height, the rate of fill of the riser 28 can be monitored and kept constant which ensures that the mold 16 itself is being filled at the same constant level.

Figure 8:
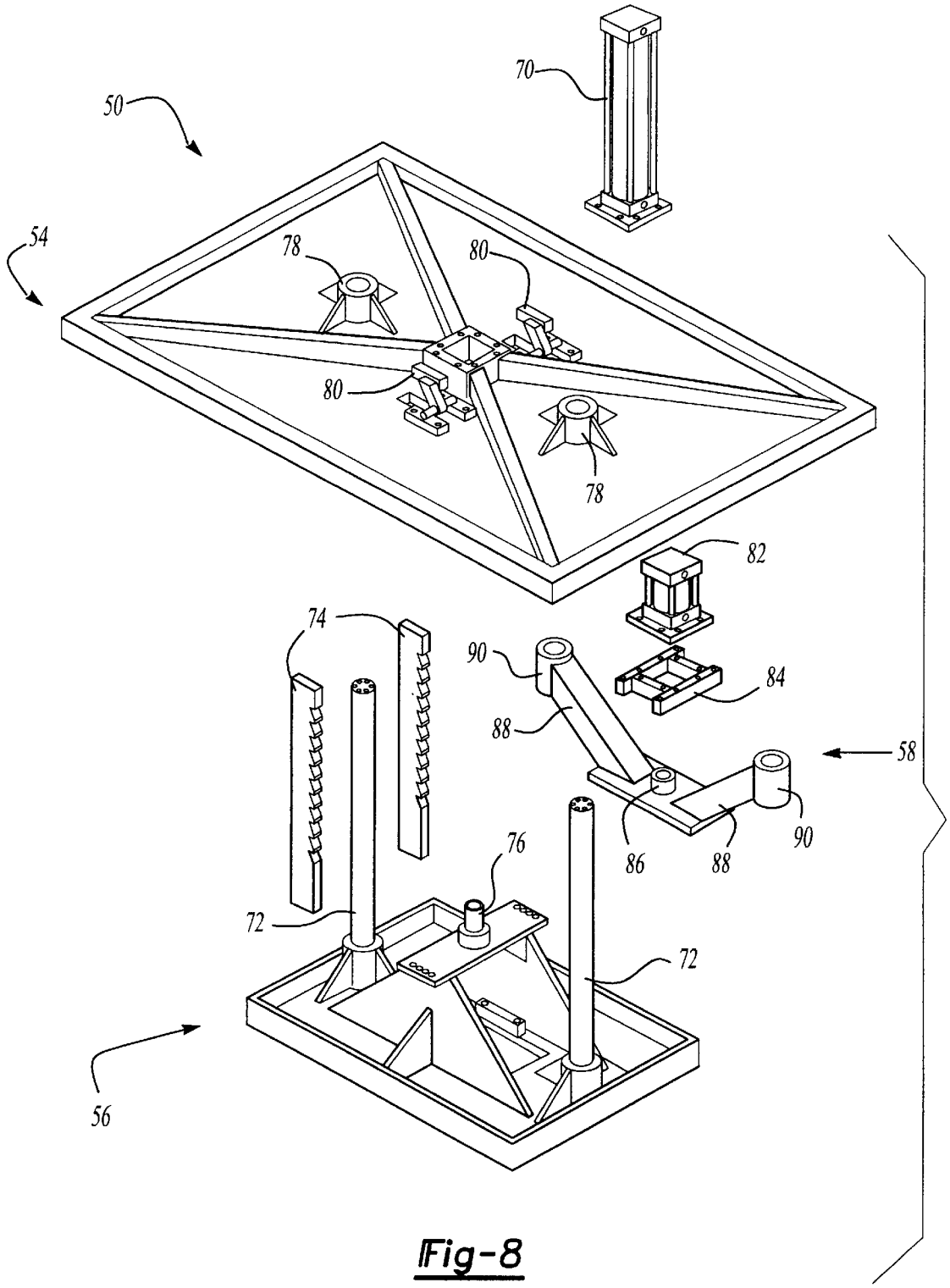
FIG. 8 is an exploded perspective view of the mold press of the present invention.
Figure 9:
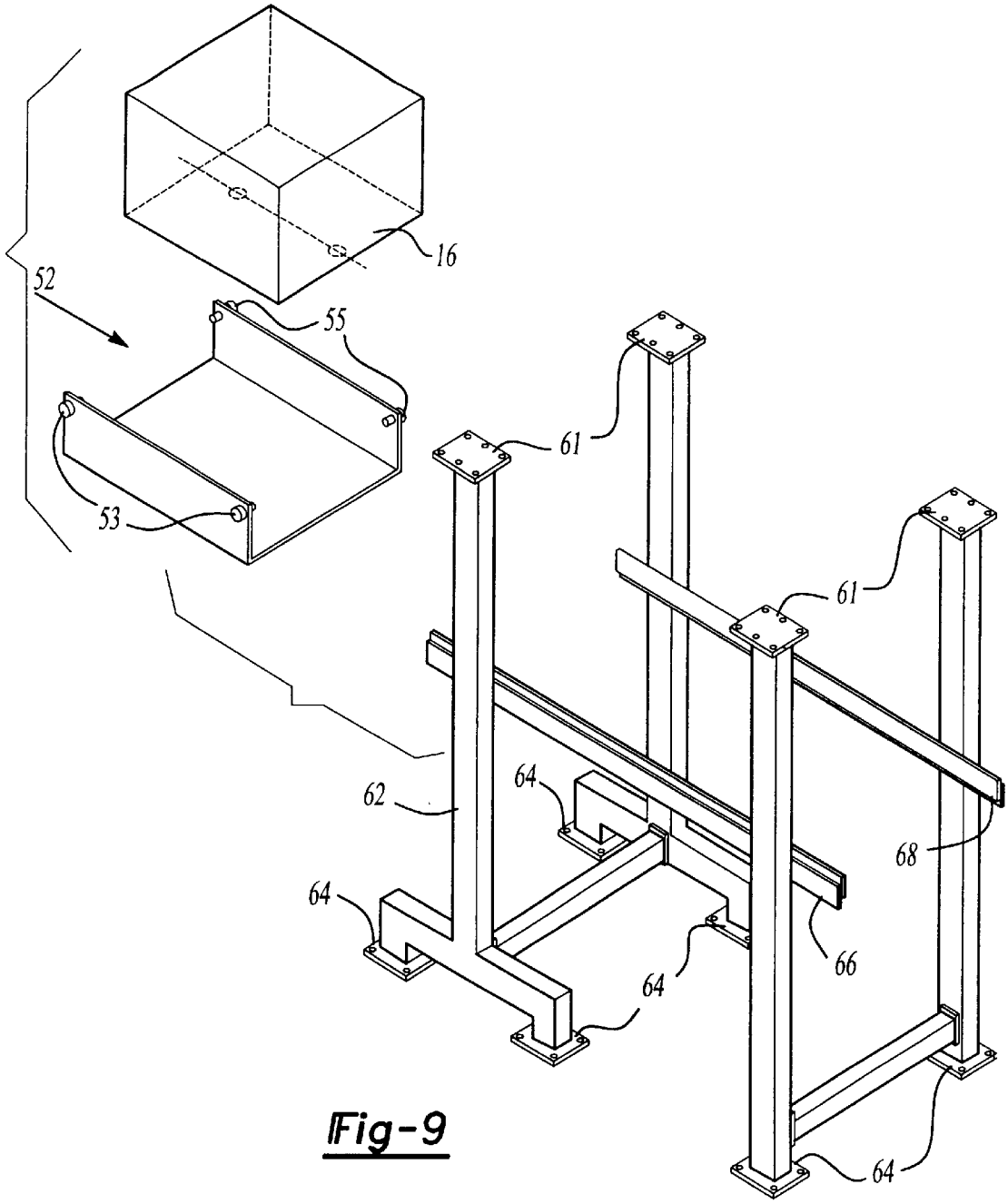
FIG. 9 is a perspective view of the support columns use to support the mold press.
Figure 10:
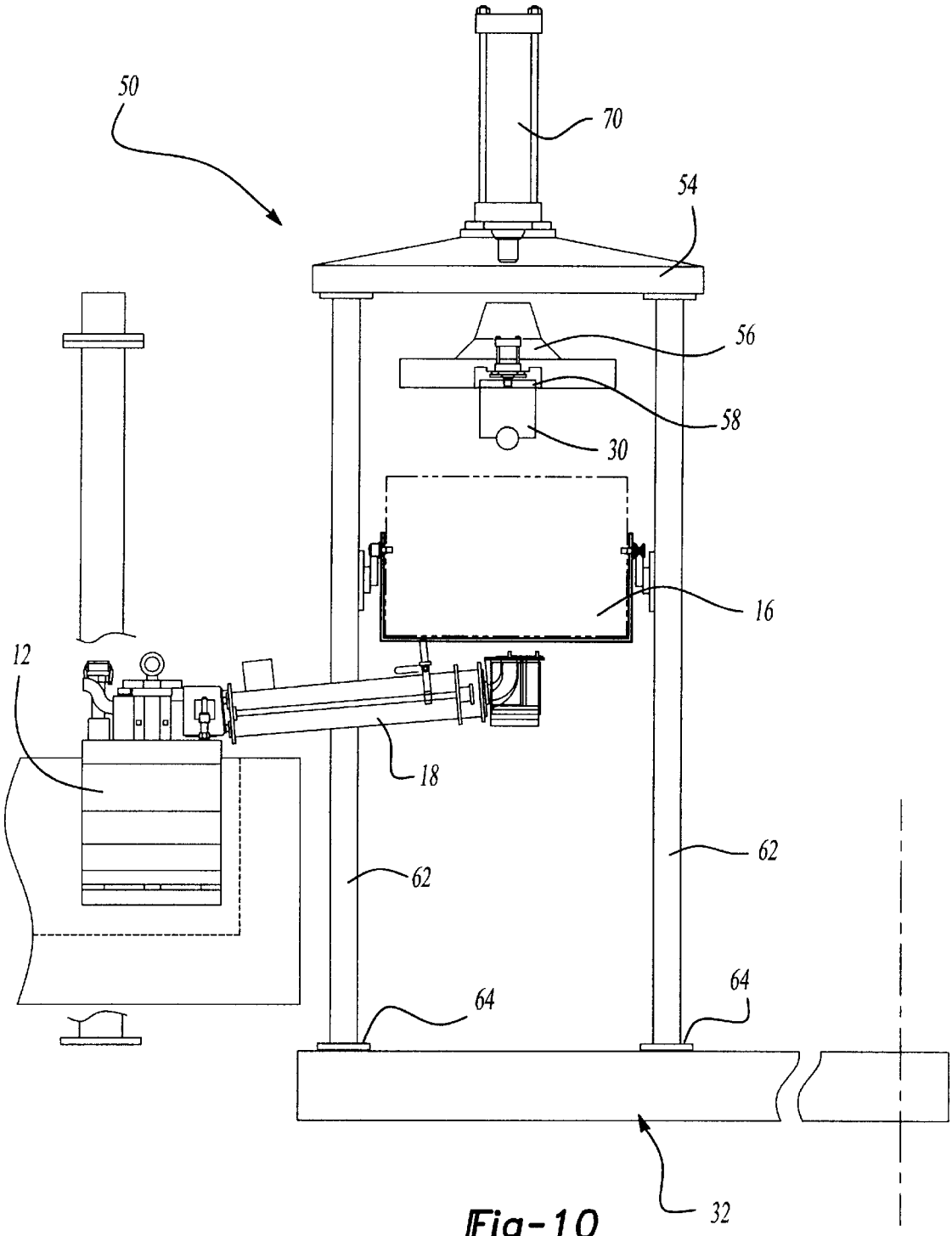
FIG. 10 is a side view of the casting system of the present invention.

With reference to FIGS. 8, 9 and 10, a mold press is generally shown at 50. It should be understood that other press assemblies and transport systems could be used, for example a clam shell system a conveyor, a robotic placement unit, a walking beam, etc. In the disclosed embodiment, there are several mold presses 50 mounted to turntable 32. Mold press 50 includes a press crown 54 mounted upon a support frame through flanges 61. The legs 62 of support frame are bolted through plates 64 to the turntable 32. A ram 56 is movably mounted to the crown 54. A semi-permanent mold cope platen 58 is movably mounted to the ram 56. A mold transport system is employed to move the mold 16 into position with respect to the mold press 50. In the disclosed embodiment, the mold cart 52 is received upon rails 66 and 68 mounted to legs 62 to allow the cart 52 to slide with respect to the mold press 50. In this way, the mold 16 can be transported upon the cart 52 and properly positioned within the mold press 50. In the preferred embodiment, the cart 52 has two pair of wheels 53 and 55.

The wheels 53 are v-shaped wheels and mate with the v-shaped rail 66. Wheels 55 are flat and mate with the flat surface of rail 68. Using these differently shaped wheels, the cart can properly slide on the rails 66 and 68 without binding and remain accurate.

The ram 56 is mounted to the press crown 54 through a main cylinder 70, guide rods 72 and slide locks 74. Cylinder 70 is mounted to the crown 54 through for example bolts and to the ram 56 at pin 76. In the preferred embodiment, cylinder 70 is a hydraulic cylinder and has a 24 inch stroke. The guide rods 72 reciprocate within guide bushings 78. Though actuation of the cylinder 70, the ram 56 can be raised and lowered with respect to the mold 16. Slide locks 74 are normally locked within the slide lock pawls 80 to lock the ram 56 in place in the event of power failure. To move the ram 56, pressure from a fluid source, such as an air source, is needed to release pawls 74.

Semi-permanent mold cope platen 58 is mounted to the ram 56 through a semipermanent mold cope extract cylinder 82 and guide rods 72. The semi-permanent mold cope extract cylinder 82 is mounted to the ram 72 through a mounting frame 84. The cylinder 82 connects to a pin 86. The semi-permanent mold cope platen 58 has angled arms 88 with guide bushings 90 at distal ends thereof. The guide bushings 90 receive guide rods 72. The semi-permanent mold cope 30 is connected to the semi-permanent mold cope platen 58 so that it can be raised and lowered with respect to the mold 16. The ram 56 has an opening to allow the semi-permanent mold cope to be raised and lowered with respect to the mold 16 and the ram 56.

Figure 7:
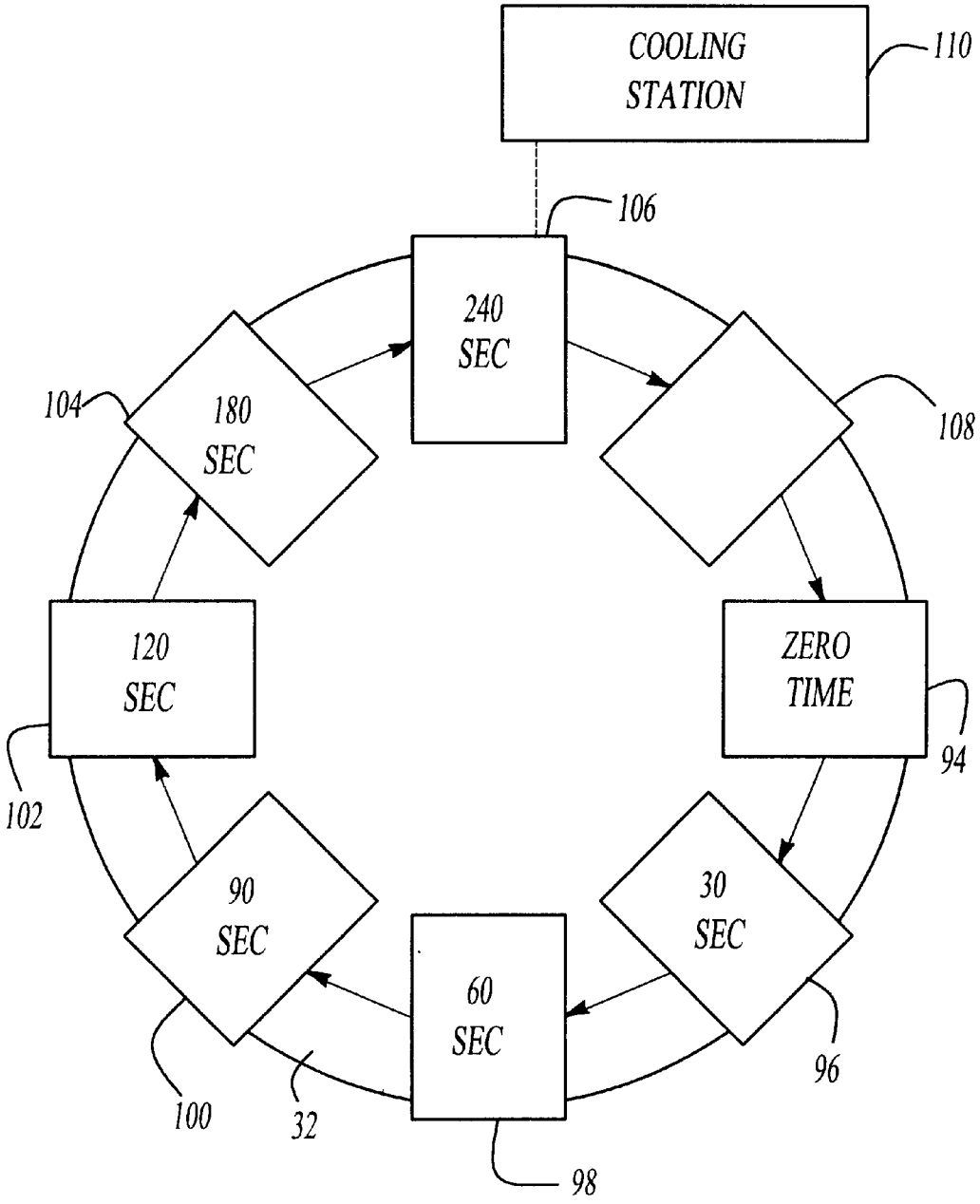
FIG. 7 is a schematic view of the turntable of the present invention.

In use, the mold 16 is positioned upon the cart 52. Cart 52 is slid upon rails 66 and 68 to a positioned beneath the ram 56. With reference to FIG. 7, an example of the filling process is shown. The loading position is shown as 94. The ram 56 is then lowered against the top of the sand mold 16 and presses against it. The semipermanent mold cope platen 58 is also lowered to properly position the semi-permanent mold cope 30 on the mold 16. It should be appreciated that the ram 56 and platen 58 are moving independently of each other, but could move simultaneously if desired. This is position 96 in FIG. 7. The mold is then filled at position 98. In the preferred embodiment, the laundered 18, also known as a fill tube or pipe, interconnects the furnace 12 and the mold 16. See FIG. 10. The molten fill in the mold 16 is then allowed to solidify in positions 100, 102 and 104. At removal station 106, the mold is removed from the turntable 32. In this position, the semi-permanent mold cope platen 58 is raised initially. The ram 56 is held in position against the mold 16. In this way, the platen 58 can be raised which removes the semi-permanent mold cope 30 without disturbing the mold 16. It should be remembered that the semi-permanent mold cope 30 is in contact with the metal in the mold 16 and the ram 56 is in contact with the sand of the mold 16. When the platen 58 is raised the metal in the mold 16 is exposed. Once the platen 58 is raised, the ram 56 can be raised to allow the cart 52 to be removed from the mold press 50. In the disclosed embodiment, a complimentary rail system would be automatically aligned with the rails 66 and 68 to allow easy removal and transfer of the cart 52 and transfer to cooling station 110.

While the invention has been described in detail with reference to certain preferred embodiments, variations and modifications exist within the scope and spirit of the invention as described and as defined in the following claims.

What is claimed is:

1. A casting system comprising:

a turntable;

a plurality of molds mounted about said turntable;

a furnace mounted adjacent said turntable, said furnace being operatively connected to each of said molds as each of said molds are brought into a fill position with respect to said furnace; each of said molds being adapted to be filled with molten metal at said fill position;

a flow cut-off cutting off molten metal flow from said furnace to each of said molds as each of said molds moves from said fill position; and a plurality of semi-permanent mold copes mounted to said turntable with one of said semi-permanent mold copes mounted adjacent to each of said molds, said semi-permanent mold copes being movably mounted for engaging and disengaging said molds as said turntable moves from said fill position to a plurality of cooling positions wherein said semi-permanent mold copes provide a rapid cooling to a portion of said metal within said molds when said semi-permanent mold copes engage said molds.

2. A casting system as set forth in claim 1, wherein said semi-permanent mold cope is constructed of steel.

3. A casting system as set forth in claim 1, further comprising flow channels in said semi-permanent mold cope for circulation of cold fluid.

4. A casting system as set forth in claim 1, wherein said semi-permanent mold copes are fluidly controlled for closing upon said molds.

5. A casting system as set forth in claim 1, further comprising a launderer for transporting molten metal from said furnace to said mold.

6. A casting system as set forth in claim 1, further comprising a first mold transport system located adjacent to said turntable for transporting said molds to said turntable.

7. A casting system as set forth in claim 6, further comprising a second mold transport system located adjacent to said turntable for transporting said molds away from said turntable for cooling.

8. A casting system as set forth in claim 1, wherein said mold is made of sand.

9. A casting system as set forth in claim 1, further comprising a forced air cooling source for applying forced air to said mold after said semi-permanent mold cope has been removed after filing of said mold.

10. A casting system of claim 1, further including a mold press, said mold press including a ram moveable with respect to said mold, a semi-permanent mold cope platen containing said semi-permanent mold cope movably mounted with respect to said ram, said ram being adapted to engage said mold adjacent said cavity, said semi-permanent mold cope platen being movable into said cavity and adapted to move said semi-permanent mold cope into said cavity to close said cavity for receipt of molten metal.

11. A casting system of claim 10, further including a cart for supporting said mold and transporting said mold to and from said mold press.

12. A casting system of claim 10, further including a rail upon which said cart is slidably supported.

* * * * *